US011210930B2

(12) United States Patent
Penning et al.

(10) Patent No.: US 11,210,930 B2
(45) Date of Patent: Dec. 28, 2021

(54) DEVICE, METHOD, AND CONTROL MODULE FOR MONITORING A TWO-WIRE LINE

(71) Applicant: Minimax GmbH, Bad Oldesloe (DE)

(72) Inventors: Daniel Penning, Luebeck (DE); Jöm Katzorke, Hamburg (DE)

(73) Assignee: Minimax GmbH, Bad Oldesloe (DE)

( * ) Notice: Subject to any disclaimer, the term of this patent is extended or adjusted under 35 U.S.C. 154(b) by 0 days.

(21) Appl. No.: 17/055,115

(22) PCT Filed: May 22, 2019

(86) PCT No.: PCT/EP2019/063244
§ 371 (c)(1),
(2) Date: Nov. 12, 2020

(87) PCT Pub. No.: WO2019/224264
PCT Pub. Date: Nov. 28, 2019

(65) Prior Publication Data
US 2021/0217296 A1 Jul. 15, 2021

(30) Foreign Application Priority Data
May 23, 2018 (DE) ..... 10 2018 112 299.3

(51) Int. Cl.
*G08B 29/06* (2006.01)
*G08B 17/06* (2006.01)

(52) U.S. Cl.
CPC ..... *G08B 29/06* (2013.01); *G08B 17/06* (2013.01)

(58) Field of Classification Search
CPC ..... G08B 29/06; G08B 17/06
See application file for complete search history.

(56) References Cited

U.S. PATENT DOCUMENTS 3,665,461 A 5/1972 Gnägi et al.
2004/0042145 A1* 3/2004 Garnett ..... G06F 1/28 361/115
2007/0085694 A1* 4/2007 Larkin ..... G08B 29/06 340/650

FOREIGN PATENT DOCUMENTS

DE 2 038 795 4/1971
DE 30 36 029 A1 5/1982
(Continued)

OTHER PUBLICATIONS

International Search Report (with English translation), International Application No. PCT/EP2019/063244 (published under WO 2019/224264), 4 pages (Aug. 20, 2019).

*Primary Examiner* — Brian Wilson
(74) *Attorney, Agent, or Firm* — Perkins Coie LLP

(57) ABSTRACT

The invention relates to a device (1) and a corresponding method for monitoring a two-wire line (2), in particular a two-wire line (2) of a fire protection system. The device (1) comprises a passive terminating component (10) for terminating the two-wire line (2), wherein the passive terminating component has a chargeable energy storage (12), a constant current source (20) for providing a measuring current (I1) to the passive terminating component, a voltage detection unit (30) for detecting a voltage curve (V1) at output terminals (4, 6) of the two-wire line (2), a control unit (40) for controlling the constant current source (12) and for evaluating the detected voltage curve, the control unit (40) being configured to separately determine a series resistance (RL) and a parallel resistance (PS) of the two-wire line (2).

13 Claims, 2 Drawing Sheets

(56) References Cited

FOREIGN PATENT DOCUMENTS

| | | | | | |
|---|---|---|---|---|---|
| EP | 0 405 247 | A1 | | 1/1991 | |
| EP | 1 816 619 | A1 | | 8/2007 | |
| EP | 2 093 737 | A1 | | 8/2009 | |
| EP | 2 232 455 | B1 | | 9/2010 | |
| EP | 2 804 163 | A1 | | 11/2014 | |
| EP | 2 916 303 | A1 | | 9/2015 | |
| EP | 2916303 | A1 | * | 9/2015 | ..... G08B 29/123 |
| EP | 3 062 299 | A1 | | 8/2016 | |
| WO | WO 2009/087169 | A1 | | 7/2009 | |
| WO | WO 2014/184107 | A1 | | 11/2014 | |

* cited by examiner

DEVICE, METHOD, AND CONTROL MODULE FOR MONITORING A TWO-WIRE LINE

PRIORITY CLAIM AND INCORPORATION BY REFERENCE

This application is a 35 U.S.C. § 371 application of International Application No. PCT/EP2019/063244, filed May 22, 2019, which claims the benefit of German Application No. 10 2018 112 299.3, filed May 23, 2018, each of which is incorporated by reference in its entirety.

TECHNICAL FIELD

The present invention relates to a device for monitoring a two-wire line, in particular a two-wire line of a fire protection system, as well as a corresponding method and a corresponding control module.

BACKGROUND AND SUMMARY OF THE INVENTION

According to Part 13 of the EN54 Standard, fire protection systems, for example, for fire detection and alarm generation, must be certified and, in particular, the compatibility of system components must be assessed. For this purpose, it is necessary, for example, that a resistance of a two-wire line to which participants such as alarm transmitters and/or triggering devices are connected does not exceed a certain value, thus ensuring that during a triggering event sufficient current or voltage can be provided and the triggering is not endangered. For two-wire lines, in particular, a series resistance $R_L$ in the longitudinal direction of the line and a parallel resistance $R_S$ between the two lines can be described. If the series resistance $R_L$ is too high, the voltage applied between the lines will not be sufficient to trigger participants such as valves. At the same time it must be ensured that the parallel resistance $R_S$ does not become too small, which would correspond to the case of a short circuit of the two lines.

Several possibilities for detecting faults on control lines in hazard alarm and control systems, for example in fire protection systems, are known from prior art.

EP 2 804 163, for example, relates to methods for measuring a line resistance $R_L$ and thus for determining faults of control lines in such a hazard alarm and control system. However, the system is not able to determine a parallel resistance between the two lines while also determining a series resistance. In other words, the system allows to determine only one of the two resistance values of interest or a total value resulting from both values.

Other solutions known from prior art can be found inter alia in EP 2 232 455, EP 2 093 737, EP 1 816 619, DE 2 038 795, DE 30 36 029.

EP 2 916 303 A1 proposes a control device and control method for a fire alarm system, the control device and control method being capable of monitoring an on-line impedance or inter-wire impedance of field wires. The device is connected to a line, with a capacitive element being terminally connected at a far end of the line. The method comprises: sampling at least three output voltages ($V_1$, $V_2$, $V_3$) of the monitoring power supply at least three different time points ($t_1$, $t_2$, $t_3$), wherein the at least three time points are all before the capacitive element reaches saturation, and the time points comprise at least three time points which satisfy: $t_2=nt_1$, $t_3=(2n-1)t_1$, where n is an integer greater than 1; and calculating, based on the at least three output voltages ($V_1$, $V_2$, $V_3$), an on-line impedance (Rc) or inter-wire impedance (Rs) of the line.

EP 3 062 299 A1 provides an apparatus and a method for detection and adaption to an end-of-line resistor in a NAC of a control panel or power booster of, for example, an alarm system and for ground fault localization in the alarm system. The apparatus may include a notification appliance circuit, where the notification appliance circuit includes a first and a second analog input terminal, and where the notification appliance circuit includes a first and a second external output terminal, and where the notification appliance circuit includes an end-of-line resistor. Current can be driven through the notification appliance circuit via the first and second analog input terminals, and the voltage can be measured at each of the first and second external output terminals. The measured voltage can indicate a value of the end-of-line resistor or a state of the notification appliance circuit such as open, shorted, ground faulted, or normal.

All known systems have in common that they either require complex, active terminating components or are unable to differentiate between series and parallel resistance and only detect a combination of series and parallel resistance. Passive terminating components may also be subject to temperature influences from semiconductor components. While the active terminating component has the advantage that it handles the monitoring of the two-wire lines itself, the component itself and its maintenance are very costly. Against this background, it was an object of the present invention to provide a device for monitoring a two-wire line, in particular a two-wire line of a fire protection system, as well as a method for monitoring such a two-wire line and a corresponding control module, which at least partially avoids the disadvantages known from the prior art.

In a first aspect, the object is achieved according to the invention by a device for monitoring a two-wire line. The two-wire line is in particular a two-wire line of a fire protection system. The device comprises a passive terminating component for terminating the two-wire line, wherein the passive terminating component has a chargeable energy storage, a constant current source for providing a measuring current to the passive terminating component, a voltage detection unit for detecting a voltage curve at output terminals of the two-wire line, a control unit for controlling the constant current source and for evaluating the detected voltage curve, wherein the control unit is configured to separately determine a series resistance and a parallel resistance of the two-wire line.

Given that the passive terminating component has a chargeable energy storage, the control unit makes it possible to charge the chargeable energy storage by means of the constant current source. The detected voltage curve, which is evaluated, for example, both during and after the operating of the constant current source, makes it possible to determine both the series resistance and the parallel resistance of the two-wire line in a simple way, since the voltage curve, on the basis of fundamental laws, depends on these resistances.

While the measuring current is provided, the chargeable energy storage is charged, resulting in an increasing voltage. Without the provision of the measuring current, the parallel resistance of the two-wire line will form a closed circuit together with the terminating component, thus leading to self-discharging of the chargeable energy storage.

In particular, during a time when the constant current source is not operated no voltage drops across the series resistance, such that the voltage curve is only indicative of the parallel resistance. In this way, the voltage curves detected during a time when measuring current is provided and a time when measuring current is not provided allow conclusions to be drawn about both the parallel resistance and the series resistance.

It is particularly preferred that the passive terminating component is arranged at one end of the two-wire line, with that end being remote from a fire alarm and/or extinguishing control center. The arrangement at the end allows in particular for the complete longitudinal portion of the line resistance between the output terminals to be detectable.

In a preferred embodiment, the chargeable energy storage of the passive terminating component is designed as a capacitor that is arrangeable between the two wires of the two-wire line. A capacitor is a particularly simple and effective form of a chargeable energy storage. In other embodiments, other chargeable energy storages are also conceivable, for example, accumulators. In principle, preferably all chargeable energy storages which have a differential equation for the charging and discharging process that is equivalent to that of the capacitor are suitable for the method.

In a preferred embodiment, the capacitor has a capacitance that is above 0.1 μF, particularly above 1 μF, and particularly preferred in the range from 1 μF to 10 μF. A capacitance in the preferred range ensures that the charging and self-discharging of the capacitor caused by the measuring current can take place within a timeframe that is sufficient for an effective determination of the line resistances according to Part 13 of EN54.

In a preferred embodiment, the control unit is configured to evaluate the voltage curve in response to a change in the provided measuring current.

In particular there are jumps in the detected voltage curve when switching on and off the constant current source. The jumps are a direct indication of a line resistance. The accuracy of the determination therefore initially depends only on the accuracy of the discrete measured values of the voltage curve directly after switching on and off.

In a preferred embodiment, the control unit is configured to charge the chargeable energy storage during a predetermined first period by controlling the constant current source and to evaluate a self-discharging of the chargeable energy storage during a subsequent second period after switching off of the constant current source. Preferably a voltage of the chargeable energy storage is also evaluated during the first period. For example, the predetermined first period is 0.5 ms. The predetermined second period preferably follows directly after the predetermined first period and is, for example, also 0.5 ms. These exemplary values have proven to be particularly practical, but of course other durations of the first or second period are also conceivable. In particular, the two periods may also be different.

In a preferred embodiment, the control unit is configured to determine the series resistance and the parallel resistance of the two-wire line based on the voltage curve over time during the first and second period. Depending on the application, longer or shorter periods are of course also possible and the second period may also have a duration that differs from that of the first period.

Preferably, the predetermined second period is followed by a predetermined third period before a new measurement starting with the first period takes place. During the third period, the chargeable energy storage is preferably completely discharged, such that the renewed determination of the line resistances begins with a voltage of 0 V. Accordingly, the constant current source is preferably also switched off during the third period.

Preferably, the chargeable energy storage is discharged during the third period, for example, via a discharge resistor that can be switched on.

In a preferred embodiment, the control unit is configured to determine the series resistance of the two-wire line on the basis of a voltage change during the switching on and/or off of the constant current source.

This simple determination requires also high accuracy and resolution of the development over time of the measured value.

In a preferred embodiment, the control unit is configured to determine the parallel resistance and the series resistance of the two-wire line on the basis of two approximations, based on one another, of the voltage curve during the first and second period. In this context, in particular, the second period is to be evaluated first, and then, based on this, the first period.

In a preferred embodiment, the control unit is configured to use discrete values of the detected voltage curve, in particular by means of the least squares method, to approximate constants of two linear equations of the voltage in the first order of a time-dependent variable during the first and second period.

Thus, both linear equations lead to two parameters each, one constant parameter and one parameter that is time-dependent in the first order. Explained in simple terms, a graph of the linear equations respectively corresponds to a straight line, where the two parameters then indicate the ordinate intercept and the slope of the line. The time-dependent variable may have a linear dependence on time, i.e. directly on time, or, preferably, an exponential functional dependence on time. The exponential dependence on time corresponds to the exponential progress of charging and discharging, especially of capacitors. The series resistance and the parallel resistance can then be derived with high accuracy from the two parameters each obtained from the equations.

In addition, the approximations mean that it is not necessary to calibrate or measure the capacity of the chargeable energy storage in order to draw conclusions about the resistances from the voltage curve over time. This capacity is also obtained from the approximations and can be derived from the parameters of the two equations.

In a preferred embodiment, the control unit is configured to monitor multiple two-wire lines. This simplifies the overall design of the device by eliminating the need for multiple control units to monitor multiple two-wire lines, for example, for fire protection systems that regularly comprise a large number of two-wire lines. In the same way, the constant current source may also be configured to supply multiple of the two-wire lines with a constant current. Of course, combinations of several control units and/or constant current sources are also conceivable for monitoring.

In a further aspect, the object mentioned at the beginning is achieved by a method for monitoring a two-wire line. The two-wire line is in particular a two-wire line of a fire protection system. The method comprises: providing a measuring current to a passive terminating component for terminating the two-wire line, wherein the passive terminating component has a chargeable energy storage, detecting a voltage curve at output terminals of the two-wire line, and evaluating the detected voltage curve to determine a series resistance and a parallel resistance of the two-wire line.

The method according to the invention provides the same advantages as those obtained with the device according to the invention for monitoring a two-wire line. Furthermore, all embodiments of the device described as preferred can be combined in an analogous manner with the method according to the invention.

In a preferred embodiment, the measuring current is provided during a first period for charging the chargeable energy storage and is not provided during a subsequent second period, while a voltage curve at output terminals is recorded and evaluated during the first period and the second period.

In a preferred embodiment, the parallel resistance and the series resistance of the two-wire line are determined on the basis of two approximations, based on one another, of the voltage curve during the first and second period.

In a preferred embodiment, discrete values of the detected voltage curve are used to determine the parallel resistance and series resistance from approximated constants of two linear equations of the voltage in the first order of a time-dependent variable during the first and second period.

In a further aspect, the object mentioned at the beginning is achieved by a control module of a fire alarm and/or extinguishing control center for monitoring a two-wire line of a fire protection system, the control module being configured to carry out the method according to the invention.

In another aspect, the object mentioned at the beginning is achieved by using a capacitor as a passive terminating component for terminating a two-wire line of a fire protection system.

BRIEF DESCRIPTION OF THE DRAWINGS

Further advantages and designs are described below with reference to the accompanying drawings. The figures show.

MODE(S) FOR CARRYING OUT THE INVENTION

Figure 1:
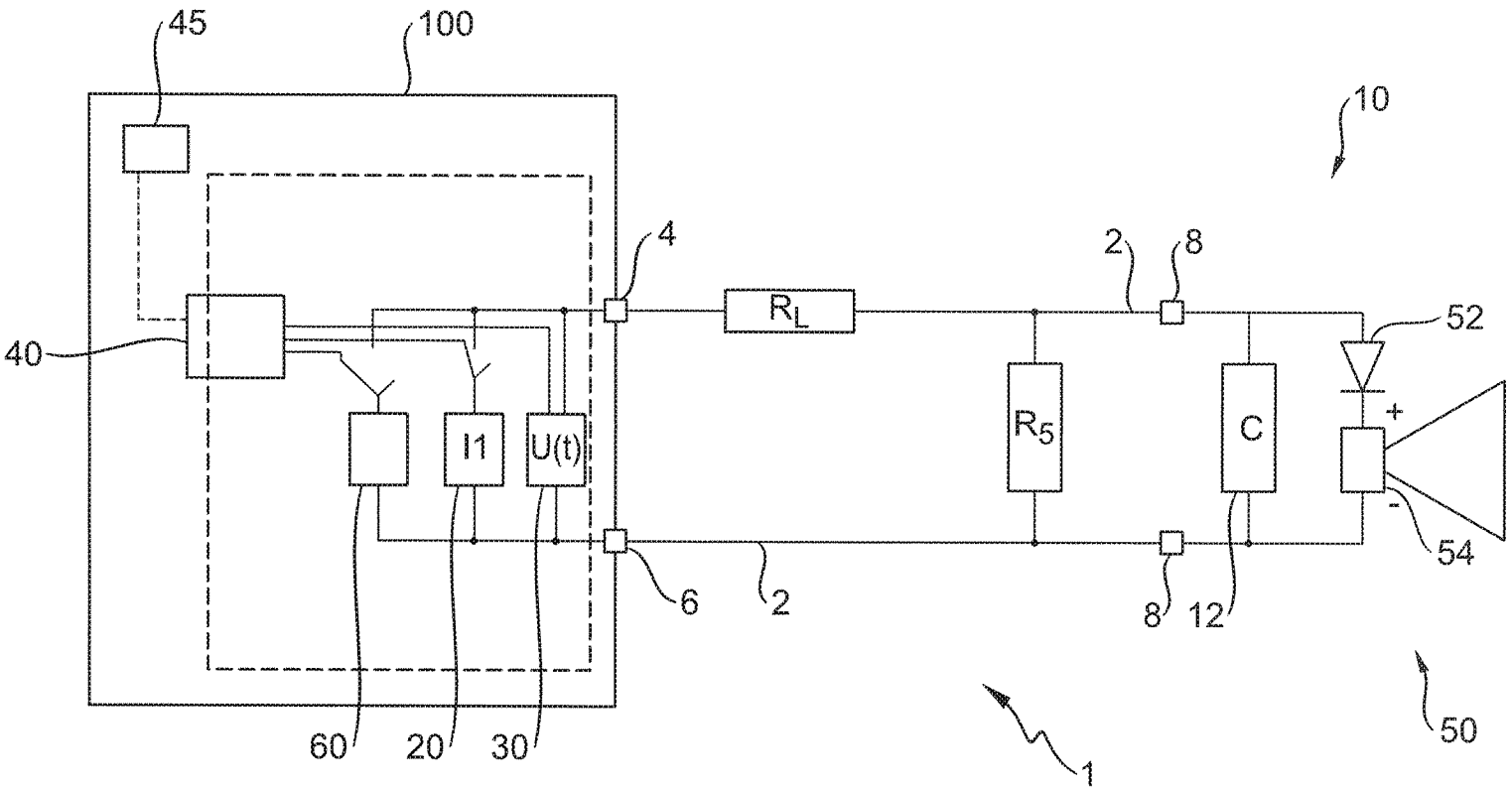
FIG. 1: schematically and exemplarily shows an example of a device according to the invention for monitoring a two-wire line

FIG. 1 schematically and exemplarily shows a first example of a device 1 according to the invention for monitoring a two-wire line 2. The two-wire line 2 is connected at two output terminals 4, 6, for example, to a center 100 of a fire protection system, such as a fire alarm and/or extinguishing control center. It is important to ensure that resistances occurring via the cable are within the permissible range, such that, for example, sufficient voltage drops or is present in a triggering event.

A terminating component 10 with a reverse polarity protection designed as diode 52 and a load represented as resistor 54 is typically provided at a termination 8 of the two-wire line. In this way, a short circuit via the two-wire line is prevented and, at the same time, the possibility of monitoring with a current flowing through the terminating component 10 is provided. In particular, due to the reverse polarity protection no monitoring current ever passes through the terminating component 10.

The two-wire line, to which in particular multiple participants such as detectors, alarm transmitters, etc. are connected, can be modelled as a combination of series resistance $R_L$ and parallel resistance $R_S$. One aim of the present invention is the ability to determine or monitor the series resistance $R_L$ and the parallel resistance $R_S$ separately. For this purpose, the invention proposes a particularly simple passive terminating component 10 which is connected to the termination 8 of the two-wire line 2. Compared to the conventional terminating component 50, which only determines the total line resistance, this makes the separate determination of $R_L$ and $R_S$ possible.

The terminating component 10 according to the invention has a chargeable energy storage 12, which in the example shown is designed as a capacitor with a capacitance C. Furthermore, the passive terminating component 10 does not show any temperature dependence of the determination, such that the capacitance C can be determined automatically and, thus, no configuration/calibration of the terminating component 10 is necessary.

In accordance with the invention, a control unit 40 now determines the parallel resistance $R_S$ and the series resistance $R_L$ together with the capacitance C on the basis of a voltage curve U(t), the function of which is described with reference to FIG. 2.

A constant current source 20 is arranged between the output terminals 4, 6 to provide a constant but preferably adjustable measuring current I1 via the chargeable energy storage 12 of the passive terminating component 10.

Furthermore, a voltage detection unit 30 is provided for detecting a voltage curve U(t) between the output terminals 4, 6. The control unit 40 is configured to control the constant current source 20 and to evaluate the voltage curve U(t) detected by the voltage detection unit 30. Here the control unit 40 enables the convenient determination of the series resistance $R_L$ and the parallel resistance $R_S$ of the two-wire line 2, as explained below.

In summary, the control unit 40 is intended to be able to make a reliable statement as to whether the existing line resistances $R_L$, $R_S$ enable sufficient voltage to be applied to the load in a triggering event.

The control unit 40 is either designed as a separate module, for example, within the fire alarm and/or extinguishing control center 100, or may be designed as an integral part of the fire alarm and/or extinguishing control center 100. In a preferred case, all the components of the device 1 for monitoring a two-wire line which are provided on the side of the center are designed in the form of a monitoring module, which is shown in FIG. 1 with dashed lines. In this case, for example, a further control unit 45 of the fire alarm and/or extinguishing control center 100 will handle the supplementary functions for fire monitoring and/or extinguishing control.

The voltage curve U(t) at the module terminals 4, 6 is measured continuously. Here, the chargeable energy storage 12 is first charged with the current I1 via the constant current source 20 for a certain period T1. Subsequently, the constant current source 20 is switched off and the self-discharging of the capacitance C via the parallel resistor $R_S$ is observed over a period T2. Finally, the chargeable energy storage 12 is completely discharged during a subsequent period T3 via a discharge resistor of a discharge unit 60.

Figure 2:
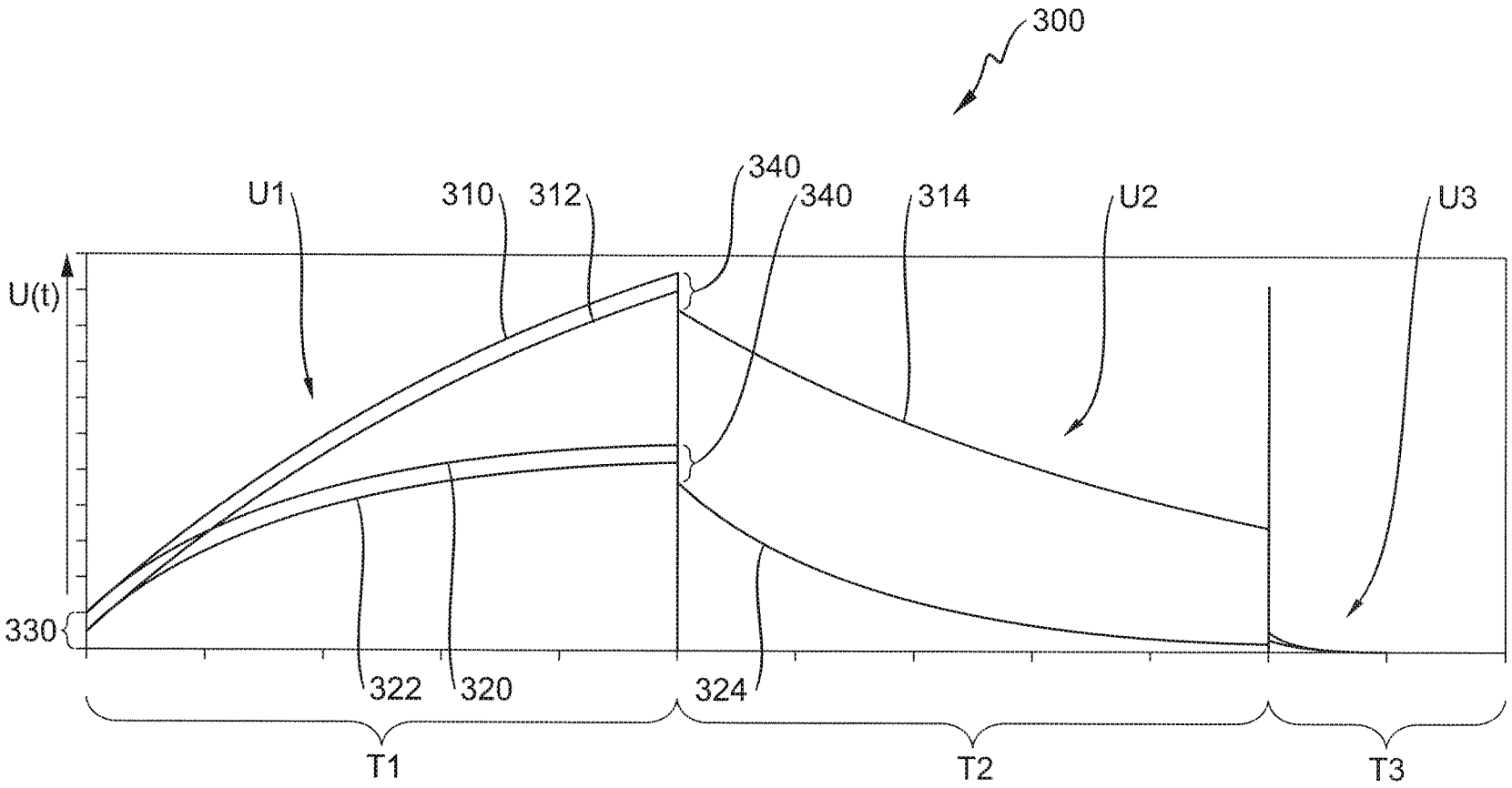
FIG. 2: schematically and exemplarily shows voltage curves at different resistances.

FIG. 2 schematically shows a diagram 300 in which the detected voltage over time U(t) is represented. In particular, the subdivision into the periods T1, T2 and T3 has been made and four different voltage curves 310, 312, 320, 322 for respectively two different values of the series resistance $R_L$ and respectively two different values of the parallel resistance $R_S$ have been recorded. During the second period T2, these four voltage curves 310, 312, 320, 322 coincide onto two voltage curves 314, 324, since the time behavior of the self-discharging is independent of the series resistance $R_L$.

The moments in which the constant current source 20 is switched on and switched off are particularly interesting and important for the calculation. The line resistance can be determined directly from the jumps 330, 340 in the voltage curve U1. The time behavior of the self-discharging is characterized only by a time constant which depends on the capacitance C and the parallel resistance $R_S$.

The following differential equation of voltage U applies to the charging process during period T1:

$$U = IR_L + R_S\left(I - C\frac{\partial U}{\partial t}\right) \tag{1}$$

It is assumed that the capacitor is completely discharged at the beginning of each measurement, i.e. prior to period T1. With U(t=0)=0 a solution of the equation (1) is given by $$\begin{aligned} U(t) &= I\left[R_L + R_S\left(1 - e^{-\frac{t-T_S}{R_S C}}\right)\right] \\ U(0-) &= 0 \\ U(0+) &= IR_L \end{aligned} \tag{2}$$

During self-discharging, i.e. during period T2, no voltage drops across the series resistance $R_L$. Thus, the standard equation of the discharging of the capacitor can be used $$\begin{aligned} U(t) &= U(T_L+)e^{-\frac{t-T_L}{R_S C}} \\ U(T_L+) &= U_C(T_L-) \end{aligned} \tag{3}$$

The forced discharging during the third period T3 is not considered. The discharging time need only be selected long enough to ensure that the chargeable energy storage 12 is completely discharged at the beginning of the next measurement.

The 3-part measuring sequence explained above and sketched in FIG. 2 is preferably repeated periodically to determine the resistance values. Discrete voltage values are available for each measurement, which can be divided into charging and self-discharging processes. One advantage of the solution according to the invention is the short time required for the detection of a fault, which is in the range of a few milliseconds.

In the following, for further processing, the voltage curve U(t) is divided into the measured value curves U1, U2 and U3 which correspond to the periods T1, T2 and T3. Thus, in particular the measured value vectors U1 and U2 are available from the voltage detection unit 30, which are acquired during the periods T1 and T2. The aim of the following calculations is to determine from U1 and U2 as accurately as possible the parameters $R_L$ and $P_S$ as well as, incidentally, C.

For this purpose, equations (2) and (3), in which these parameters occur, are considered. It is noticeable that equation (3) contains two unknown values: The time constant $\tau = R_S * C$ and the start value $U(T_L+)$. The control unit 40 preferably first determines these constants before determining the remaining unknown values in a separate subsequent step using equation (2).

As already mentioned, the aim is to make statements about the parameters on the basis of the recorded measurement series of the voltage curves U1 and U2. Equations (2) and (3) define the progression of the voltage values over time, where the parameters that best reproduce the curve are determined by means of an estimation or approximation. In this example, the least square method is used for this purpose to project N observed measured values onto a function with the smallest possible averaged error, in this case onto a linear first-order equation of time t:

$$y(t) = \alpha + \beta t$$

With the least square method, an associated measurement error $\epsilon_i$, which describes a deviation from the ideal measurement curve, is added to the measured values $y_i$ recorded at the respective corresponding times $t_i$:

$$y_i = \alpha + \beta t_i + \epsilon_i$$

$$\begin{aligned} Q(\alpha, \beta) &= \\ y_i &= \alpha + \beta t_i + e_i \\ Q(\alpha, \beta) &= \sum_{i=1}^{N} e_i = \sum_{i=1}^{N} (y_i - \alpha - \beta t_i)^2 \overset{!}{=} \min \\ \hat{\alpha} &= \bar{y} - \hat{\beta}\bar{t} \\ \hat{\beta} &= \frac{\sum_{i=1}^{N} (t_i - \bar{t})(y_i - \bar{y})}{\sum_{i=1}^{N} (t_i - \bar{t})^2} = \frac{\mathrm{cov}(t, y)}{\mathrm{var}(t)} \end{aligned}$$

The least square method first adds the squares of the individual measurement errors $\epsilon_i$ to obtain a sum Q, which depends on the two parameters $\alpha$ and $\beta$. The subsequent minimization of this sum leads to the best estimates $\hat{\alpha}$, $\hat{\beta}$ for the parameters $\alpha$ and $\beta$.

As mentioned above, equation (3) is first used for the self-discharging process during period T2, since it is only influenced by two of the three parameters. For the sake of simplicity, the time at which the constant current source 20 is switched off is shifted to the zero time point:

$$\begin{aligned} U(t) &= U(T_L+)e^{-\frac{t}{R_S C}} \\ \tau &= R_S C \\ U(t) &= U(T_L+)e^{-\frac{t}{\tau}} \end{aligned} \tag{3a}$$

This equation is not linear but exponentially dependent on time t. As a consequence, the equation is exponential and thus non-linear and must be logarithmized on both sides to convert it into a linear first-order equation of time t.

Here the usual calculation laws for the natural logarithm are applied:

$$\begin{aligned} \log(x * y) &= \log(x) + \log(y) \\ \log(e^x) &= x \\ \log(U(t)) &= \log(U(T_L+) - \frac{t}{\tau} \\ \log(U(t)) &= \alpha_2 + \beta_2 t \end{aligned} \tag{4}$$

-continued $$\alpha_2 = \log(U(T_L+)) \tag{5}$$

$$\beta_2 = -\frac{1}{\tau} \tag{6}$$

In equation (4) the now linear form can be seen in relation to t. This means that first all detected voltages U2 are logarithmized. The least square approach can then be applied to these values in a simple way, cf. equation (4).

The parameters $\alpha_2$ and $\beta_2$ follow from the application of the least square approach to all measured values during self-discharging of U2. Subsequently, the time constant $\tau$ can be determined using equation (6):

$$\tau = -\frac{1}{\beta_2}$$

The desired parameters $R_S$, $R_L$ and C thus remain unknown. However, they can now be determined by considering the charging process.

Equation (2) already described the voltage curve of the charging process. Shifted to the zero time point and using the time constant $\tau$ it can be written as $$U(t) = I\left[R_L + R_S\left(1 - e^{-\frac{t}{\tau}}\right)\right] \tag{7}$$

In contrast to the discharging curve, this exponential curve has an additional offset. Thus, it cannot be calculated directly using the least square approach.

However, the time constant $\tau$ has already been determined. Equation (7) can thus be converted into a linear form, cf. equation (8):

$$U(t) = I(R_L + R_S) - IR_S e^{-\frac{t}{\tau}}$$

$$U(t) = \alpha_1 + \beta_1 e^{-\frac{t}{\tau}} \tag{8}$$

$$\alpha_1 = I(R_L + R_S) \tag{9}$$

$$\beta_1 = -IR_S \tag{10}$$

To do this, using the known time constant $\tau$, the corresponding exponential function must be calculated for each time value.

Upon applying the least square approach to all measured values U1, i.e. from period T1, the parameters $\alpha_1$ and $\beta_1$ are obtained. With the equations (10, 9, 3a) the desired parameters $R_S$, $R_L$ and C finally can be calculated directly:

$$R_S = -\frac{\beta_1}{I}$$

$$R_L = \frac{\alpha_1}{I} - R_S$$

$$C = \frac{\tau}{R_S}$$

This means that after each charging/self-discharging curve, the required values can be precisely specified by carrying out only two least square estimates.

The time durations T1, T2 and T3, for example, may be in the range of fractions of milliseconds, particularly 0.1-1 ms, and particularly preferred 0.5 ms, or a few milliseconds. Thus, given the short measuring time, an appropriately high rate of measurement repetition is possible.

LIST OF UTILIZED REFERENCE NUMBERS

1 Device for monitoring a two-wire line
2 Two-wire line
4, 6 Output terminal of the two-wire line
8 Termination of the two-wire line
10 Terminating component
12 Chargeable energy storage
20 Constant current source
30 Voltage detection unit
40 Control unit
45 Control unit
50 Load with reverse polarity protection
52 Diode
54 Resistor
60 Discharge unit
100 Fire alarm and/or extinguishing control center
$R_L$ Series resistance
$R_S$ Parallel resistance
C Capacity
I1 Measuring current
U(t) Voltage curve
T1 First period
T2 Second period
T3 Third period
300 Diagram
310, 312, 314, 320, 322, 324, 326 Voltage curve
330 Voltage jump
340 Voltage jump

The invention claimed is:

1. A device for monitoring a two-wire line of a fire protection system, comprising:

a passive terminating component for terminating the two-wire line, wherein the passive terminating component has a chargeable energy storage, a constant current source for providing a measuring current to the passive terminating component, a voltage detection unit for detecting a voltage curve at output terminals of the two-wire line, and a control unit for controlling the constant current source and for evaluating the detected voltage curve, the control unit being configured to determine a series resistance and a parallel resistance of the two-wire line, the control unit being configured to evaluate the detected voltage curve in response to a change in the provided measuring current and to charge the chargeable energy storage during a predetermined first period by controlling the constant current source and to evaluate a self-discharging of the chargeable energy storage during a subsequent second period after a switching off of the constant current source.

2. The device according to claim 1, wherein the chargeable energy storage of the passive terminating component comprises a capacitor arranged between the two wires of the two-wire line.

3. The device according to claim 2, wherein the capacitor has a capacitance above 0.1 μF.

4. The device according to claim 3, wherein the capacitor comprises a capacitance in a range from 1 μF to 10 μF.

5. The device according to claim 1, wherein the control unit is configured to determine the series resistance and the parallel resistance of the two-wire line from the detected voltage curve over time during the first period and second period.

6. The device according to claim 5, wherein the control unit is configured to determine the parallel resistance and the series resistance of the two-wire line on the basis of two approximations, based on one another, of the detected voltage curve during the first period and second period.

7. The device according to claim 6, wherein the control unit is configured to use discrete values of the detected voltage curve to approximate constants of two linear equations of the voltage in the first order of a time-dependent variable during the first period and second period.

8. The device according to claim 7, wherein the use of the discrete values of the detected voltage curve comprises the least squares method.

9. The device according to claim 1, wherein the two-wire line comprises multiple two-wire lines and the control unit is designed to monitor the multiple two-wire lines.

10. A method for monitoring a two-wire line of a fire protection system, the method comprising:

providing a measuring current to a passive terminating component for terminating the two-wire line, wherein the passive terminating component comprises a chargeable energy storage, detecting a voltage curve at output terminals of the two-wire line, and evaluating the detected voltage curve in order to determine a series resistance and a parallel resistance of the two-wire line, wherein the measuring current is provided in a first period for charging the chargeable energy storage and is not provided in a subsequent second period, and wherein the detected voltage curve at the output terminals is detected and evaluated during the first period and the second period.

11. The method according to claim 10, wherein the parallel resistance and the series resistance of the two-wire line are determined on the basis of two approximations, based on one another, of the detected voltage curve during the first period and second period.

12. The method according to claim 9, wherein discrete values of the detected voltage curve are used to determine the parallel resistance and the series resistance from approximated constants of two linear equations of the voltage in the first order of a time-dependent variable during the first period and second period.

13. A control module of a fire alarm and/or extinguishing control center for monitoring the two-wire line of the fire protection system, wherein the control module is configured to carry out the method according to claim 10.

* * * * *